US007988480B2

(12) United States Patent
Yao et al.

(10) Patent No.: US 7,988,480 B2
(45) Date of Patent: Aug. 2, 2011

(54) CARD EDGE CONNECTOR WITH AN IMPROVED METAL HOOK

(75) Inventors: Ze-Lin Yao, Kunshan (CN); Zhuang-Xing Li, Kunshan (CN); Xiao-Zhi Fu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/850,046

(22) Filed: Aug. 4, 2010

(65) Prior Publication Data

US 2011/0034055 A1 Feb. 10, 2011

(30) Foreign Application Priority Data

Aug. 4, 2009 (CN) ..... 2009 2 0307377

(51) Int. Cl.
*H01R 13/62* (2006.01)

(52) U.S. Cl. ..... 439/329

(58) Field of Classification Search ..... 439/327–329, 439/357–358, 74, 567, 571, 157–160; 361/756
See application file for complete search history.

(56) References Cited

U.S. PATENT DOCUMENTS

| | | | | |
|---|---|---|---|---|
| 3,829,741 | A * | 8/1974 | Athey | 361/756 |
| 4,192,478 | A * | 3/1980 | Coules | 248/220.31 |
| 4,721,473 | A * | 1/1988 | DelGuidice et al. | 439/79 |
| 4,907,987 | A | 3/1990 | Douty et al. | |
| 4,927,111 | A * | 5/1990 | Takahashi | 248/500 |
| 5,281,166 | A * | 1/1994 | Yu et al. | 439/571 |
| 5,727,970 | A * | 3/1998 | Koguchi et al. | 439/607.28 |
| 6,361,344 | B1 * | 3/2002 | Yu | 439/328 |
| 6,368,124 | B1 * | 4/2002 | Wang | 439/153 |
| 6,672,888 | B1 * | 1/2004 | Ku | 439/153 |
| 7,081,014 | B2 * | 7/2006 | Pan et al. | 439/567 |
| 7,121,862 | B2 | 10/2006 | Tang et al. | |

* cited by examiner

*Primary Examiner* — Jean F Duverne
(74) *Attorney, Agent, or Firm* — Wei Te Chung; Andrew C. Cheng; Ming Chieh Chang

(57) ABSTRACT

A card edge connector (100) includes an insulative housing (1) having a pair of opposed side walls (11), a end wall (12) connected to the side walls (11), a retainer (15) and a reinforcement wall (16) both of which protruding outwardly from the end wall (12) in a lengthwise direction of the housing (1); a plurality of terminals (2) received in the housing (1); and a metal hook (3) retained on the reinforcement wall (16) along an upper-to-lower direction of the housing (1), and having a soldering tail (32) extending beyond the housing (1) for being mounted to a mother board. The retainer (15) is connected to the reinforcement wall (16) and defines a latch projection (153) extending from an inner surface for latching a daughter board.

10 Claims, 10 Drawing Sheets

CARD EDGE CONNECTOR WITH AN IMPROVED METAL HOOK

BACKGROUND OF THE INVENTION

1. Field of the Invention

The present invention relates to card edge connectors, more particularly to a card edge connector with an improved metal hook for being mounted to a mother board.

2. Description of Related Art

Card edge connectors are employed widely in computers to receive a daughter board, a memory card, graphic card, network interface card et al. The card edge connector usually has an insulative housing, a plurality of contacts retained in the housing for electrically connecting a corresponding daughter board, and a board lock retained on the housing for fixing the card edge connector on a mother board. The housing defines a retainer for retaining the daughter board on the card edge connector. The board lock includes a fitting portion, and a mounting tail extending downwardly beyond the housing from the fixing portion. A bottom portion of the housing defines a retaining slot to retain the fixing portion. The fixing portion defines a rib for engaging with an inner wall of the retaining slot. The mounting tail is retained in a through hole of the mother board. While the computer with the card edge connector is hitted or shocked by exterior objects. The daughter board may be shocked together with the housing with respect to the board lock. Signal transmission between the daughter board and the mother board is terribly affected.

Hence, an improved card edge connector is desired to overcome the above problems.

BRIEF SUMMARY OF THE INVENTION

According to one aspect of the present invention, a card edge connector adapted for mounting on a mother board and receiving a daughter card, comprises an insulative housing having a pair of opposed side walls, an end wall connected to the side walls, a retainer and a reinforcement wall both of which protruding outwardly from the end wall in a lengthwise direction of the housing, a central slot formed among the side walls and the end wall for receiving the daughter board; a plurality of terminals received in the housing and extending into the central slot for mating with the daughter board; and a metal hook retained on the reinforcement wall along an upper-to-lower direction of the housing, and having a soldering tail extending beyond the housing for being soldered on the mother board. Wherein the retainer is connected to the reinforcement wall and defines a flexible retention arm. The retention arm defines a latch projection extending from an inner surface for latching the daughter board.

According to another aspect of the present invention, a card edge connector for being mounted to a mother board and receiving a daughter board, comprises an insulative housing having a pair of opposed side walls, an end wall connected to the side walls, a retainer protruding outwardly from the end wall in a lengthwise direction of the housing, a central slot formed between the side walls and the end wall for receiving the daughter board; a plurality of terminals received in the housing and extending into the central slot for mating with the daughter board; and a metal hook retained on the end wall along an upper-to-lower direction of the housing, and having a soldering tail extending beyond the housing for being soldered onto a hole of the mother board, the hook including a fitting portion, and a attachment portion and a projection both of which disposed at a lateral side of the fitting portion and offsetting from each other along an upper-to-lower direction of the housing. Wherein the retainer defines a latch projection extending from an inner surface for latching the daughter board. Wherein the end wall defines a through hole for receiving the fitting portion of the hook, and a block located on an inner wall of the through hole. Wherein the block of the end wall is locked with and located between the attachment portion and the projection for preventing the hook from moving along the upper-to-lower direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 2 is an exploded view of the card edge connector shown in

FIG. 1;

FIG. 5 is an exploded view of the card edge connector shown in

FIG. 4;

DETAILED DESCRIPTION OF THE PREFERRED EMBODIMENTS

Figure 1:
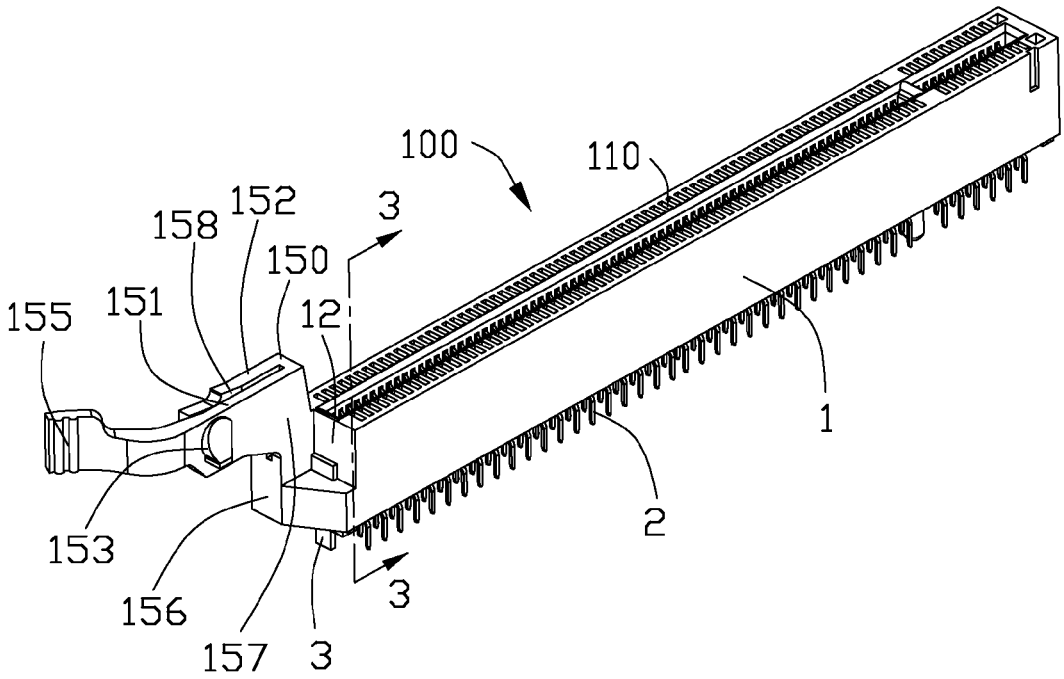
FIG. 1 is a perspective view of a card edge connector according to a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
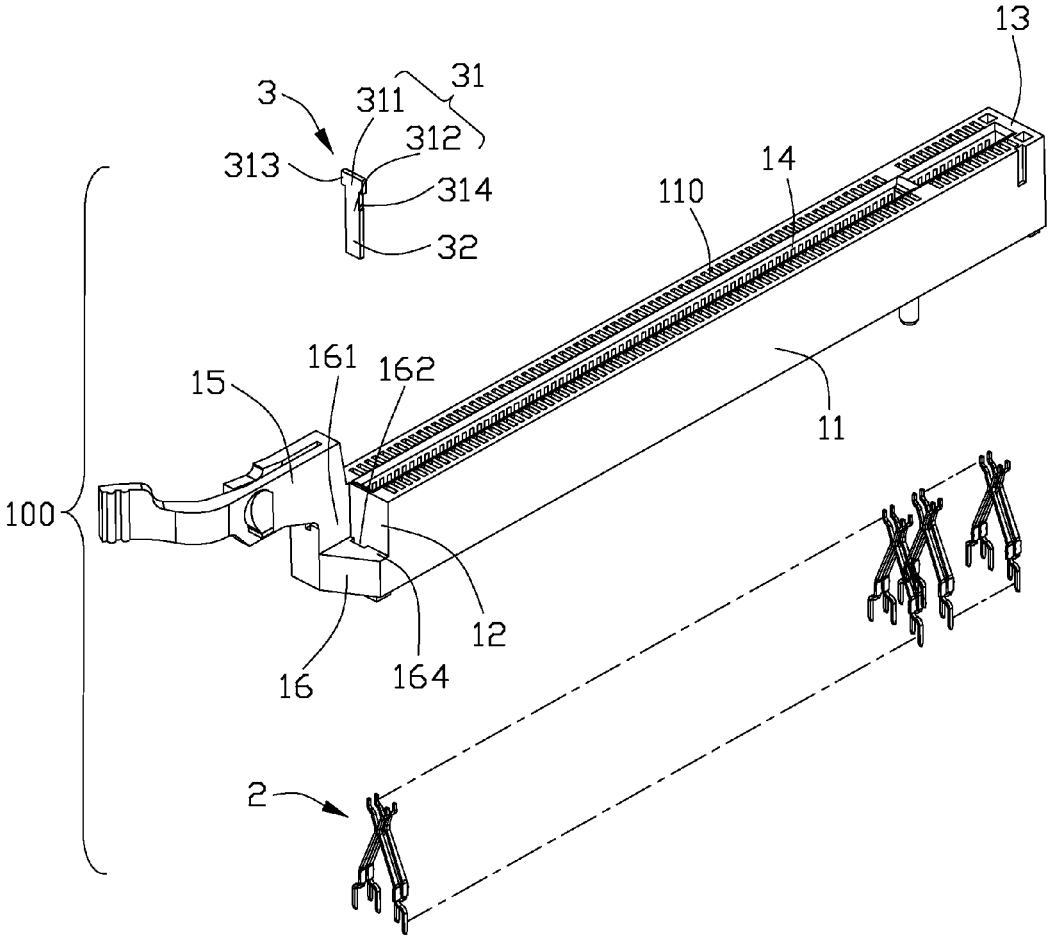
Figure 3:
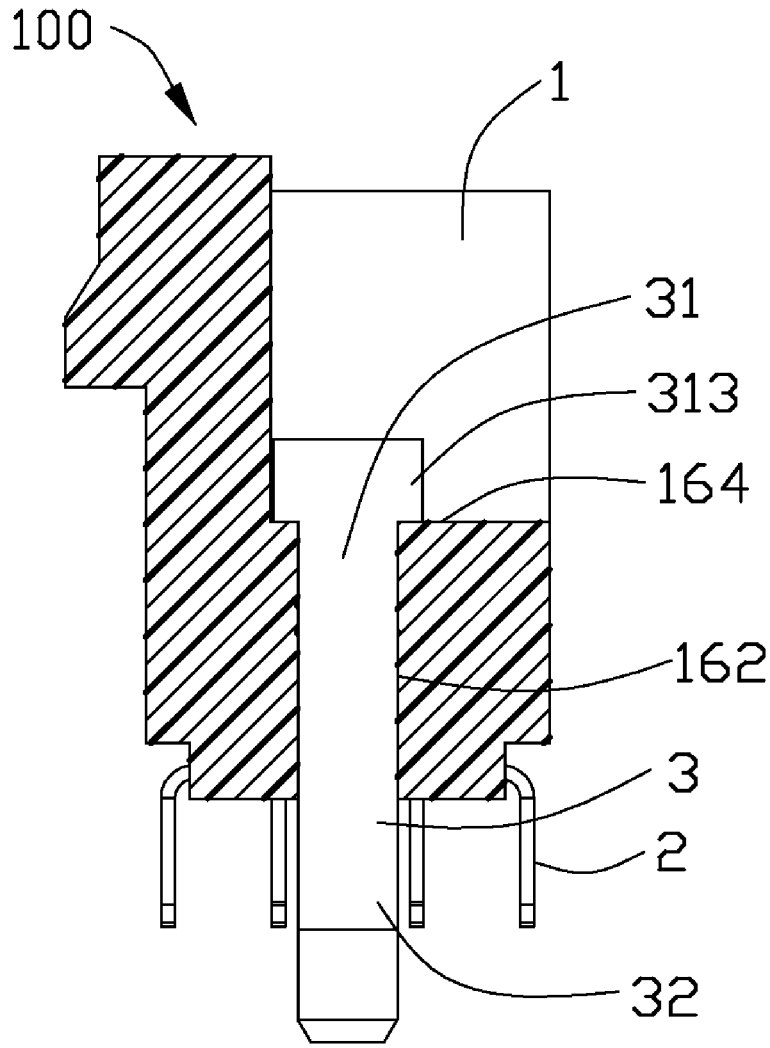
FIG. 3 is a cross-sectional view of the card edge connector taken along line 3-3 of FIG. 1.

Referring to FIGS. 1-3, a card edge connector 100 for receiving an daughter board (not shown) according to a first embodiment of the present invention is disclosed. The card edge connector 100 includes an insulative housing 1, a plurality of terminals 2 retained in the housing 1 and a metal hook 3 assembled to the housing 1 along an upper-to-lower direction of the housing 1.

The housing 1 includes a pair of elongated side walls 11, a first end wall 12, and a second end wall 13 opposited to the first end wall 12. A central slot 14 is formed between the side walls 11 and the end walls 12, 13 for receiving the daughter board. Two rows of passageways 110 are formed in the side walls 11 for retaining the terminals 2. The terminals 2 each extends into the central slot 14 for mating with the daughter board. The housing 1 further includes a retainer 15 and a level reinforcement wall 16 both of which protruding outwardly from the first end wall 12 in a lengthwise direction of the housing 1.

The retainer 15 includes a lower base 156 connected to the reinforcement wall 16, and an upper base 157 protruding upwardly from the lower base 156. Both of the lower base 156 and the upper base 157 are integrally formed with the first end wall 12. The upper base 157 defines an upright beam 150 protruding upwardly beyond the central slot 14, a flexible retention arm 151 and a stop arm 152 extending from two opposite sides of the beam 150 in the lengthwise direction of the housing 1. The stop arm 152 offsets from the retention arm 151 to define a slit 158 therebetween. The stop arm 152 is adapted for protecting the retention arm 151 from over-deflecting outwardly during the course of releasing the daughter board. The retention arm 151 defines a latch projection 153 extending from an inner surface thereof for selectively engaging with a notch of the daughter board, and a release button 155 located at a free end thereof.

The reinforcement wall 16 is a triangular shape and extends from a bottom portion of the housing 1. A receiving space 161 is formed among the reinforcement wall 16, the upper base 157 and the first end wall 12. The receiving space could receive a side edge of the daughter board while the daughter board is inserted in the card edge connector 100. The reinforcement wall 16 defines a through hole 162 passing downwardly therethrough and in communication with the receiving space 161, and an upper supporting portion 164 having a level surface surrounding a bottom portion of the receiving space 161. The first end wall 12 surrounds an inner side of the through hole 162. Certainly, the through hole 162 can also be formed on the first end wall 16 of the housing 1.

The metal hook 3 is T shape and formed from a metal plate. The hook 3 includes a fitting portion 31 and a soldering tail 32 extending downwardly from the fitting portion 31. The fitting portion 31 includes an upper fitting portion 311 defining a pair of shoulders 313 and a lower fitting portion 312 retained in the through hole 162 of the housing 1. The shoulders 313 are received in the receiving space 161 and supported on the supporting portion 164 to prevent the hook 3 from moving downwardly. The shoulders 313 each protrudes laterally beyond the lower fitting portion 312. The upper fitting portion 311 presses against the first end wall 12 in the lengthwise direction of the housing 1 for preventing the hook 3 from rotating. The shoulder 313 presses against an inner wall of the upper base 157 of the retainer 15 in a lateral direction of the housing 1. The lower fitting portion 312 defines a tooth 314 on an outer side thereof to engage with an inner side wall of the through hole 162 for preventing the hook 3 from moving in the upper-to-lower direction of the housing 1. The soldering tail 32 is for being mounted into a mounting hole of the mother board to ensure the card edge connector 100 can be mounted on the mother board reliably.

Figure 4:
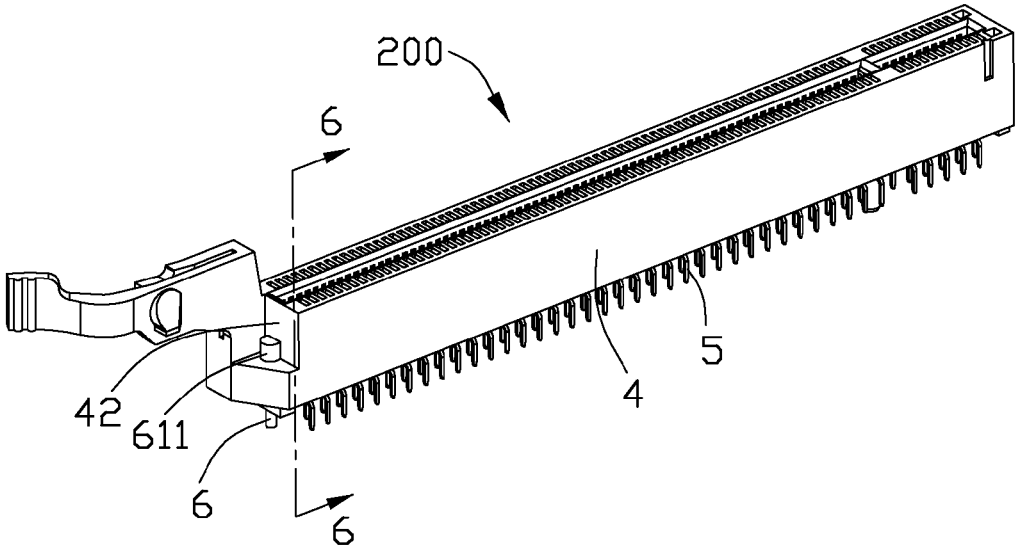
FIG. 4 is a perspective view of a card edge connector according to a second embodiment of the present invention.
Figure 5:
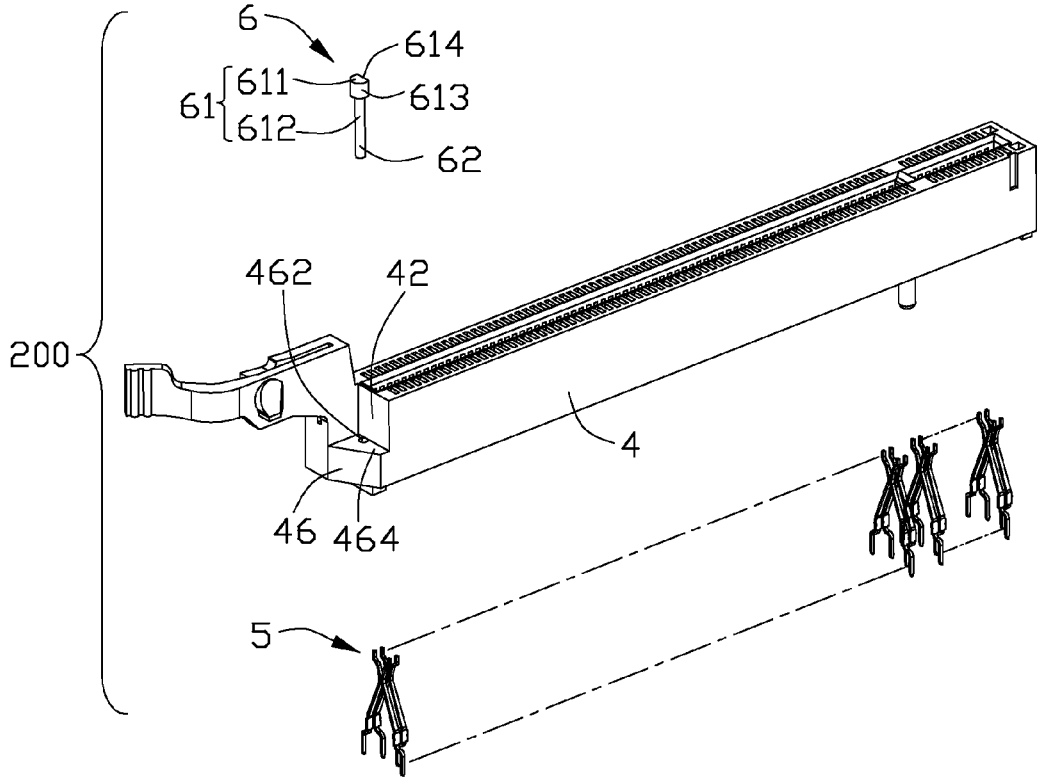
Figure 6:
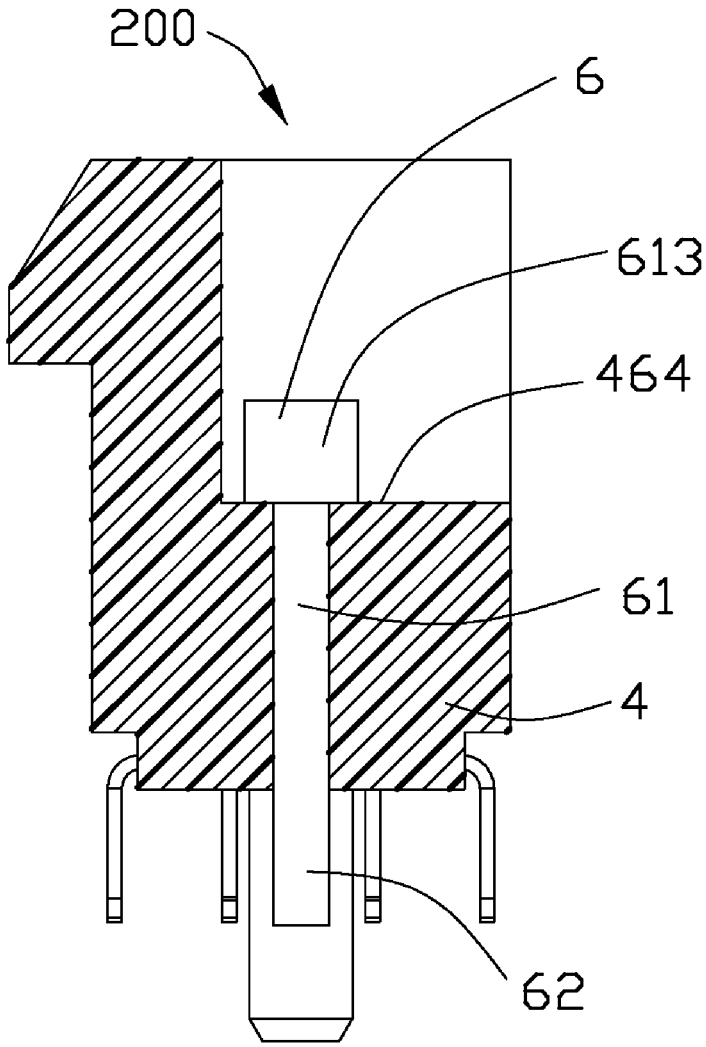
FIG. 6 is a cross-sectional view of the card edge connector taken along line 6-6 of FIG. 4.
Figure 7:
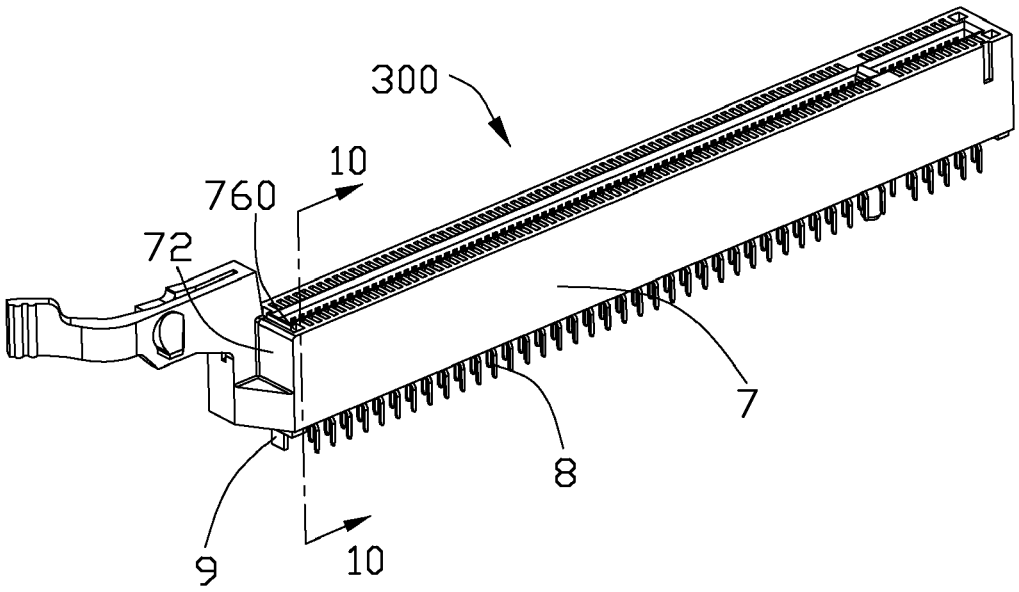
FIG. 7 is a perspective view of a card edge connector according to a third embodiment of the present invention.
Figure 8:
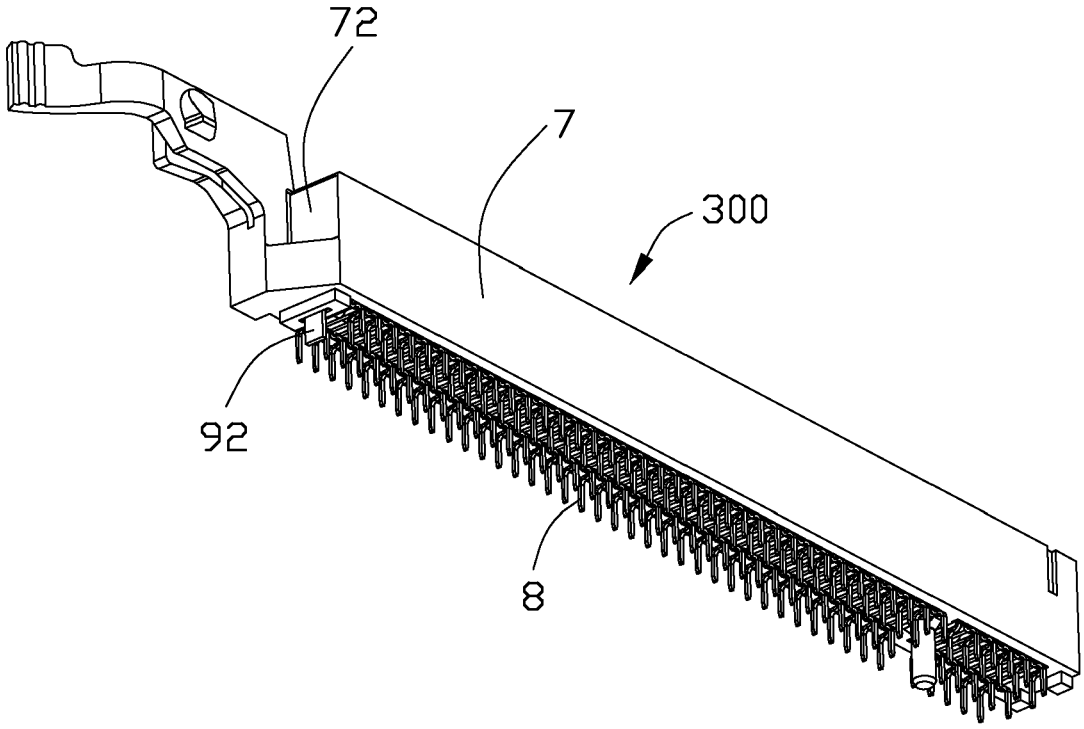
FIG. 8 is another perspective view of the card edge connector shown in FIG. 7.
Figure 9:
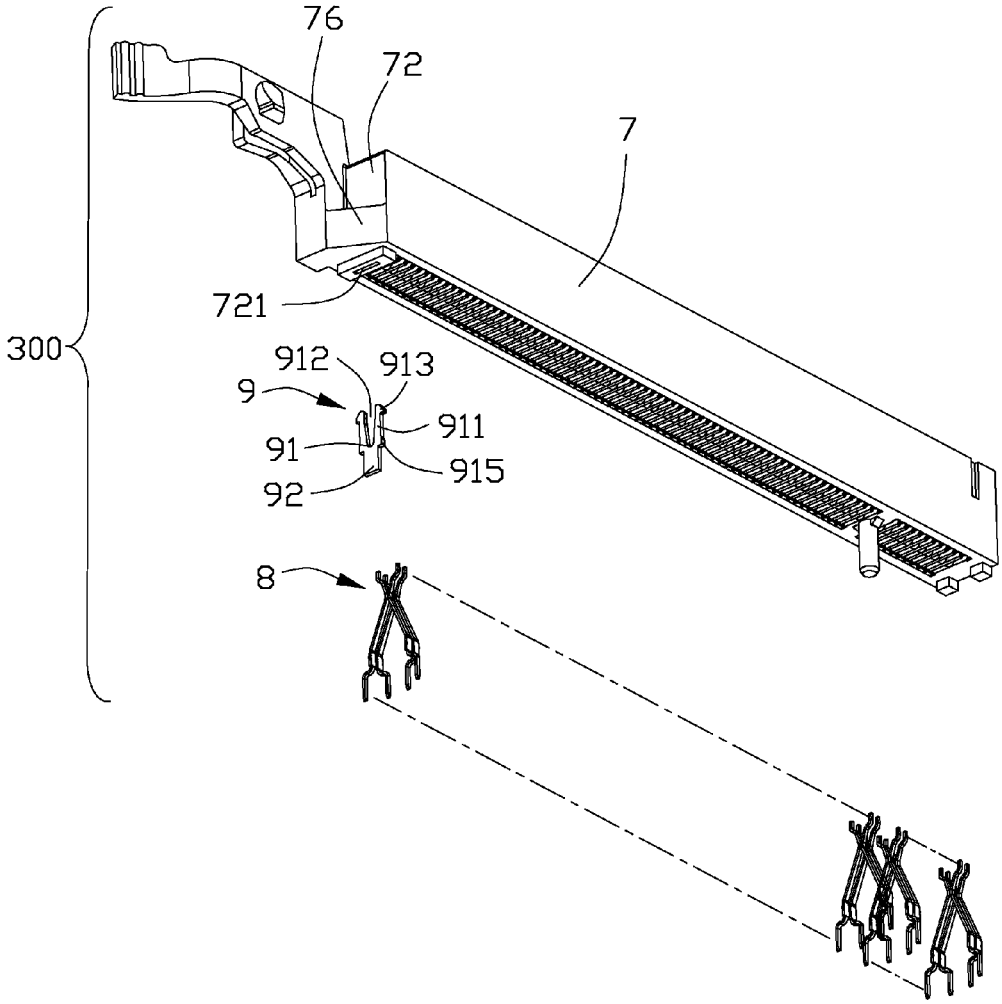
FIG. 9 an exploded view of the card edge connector shown in FIG. 7.
Figure 10:
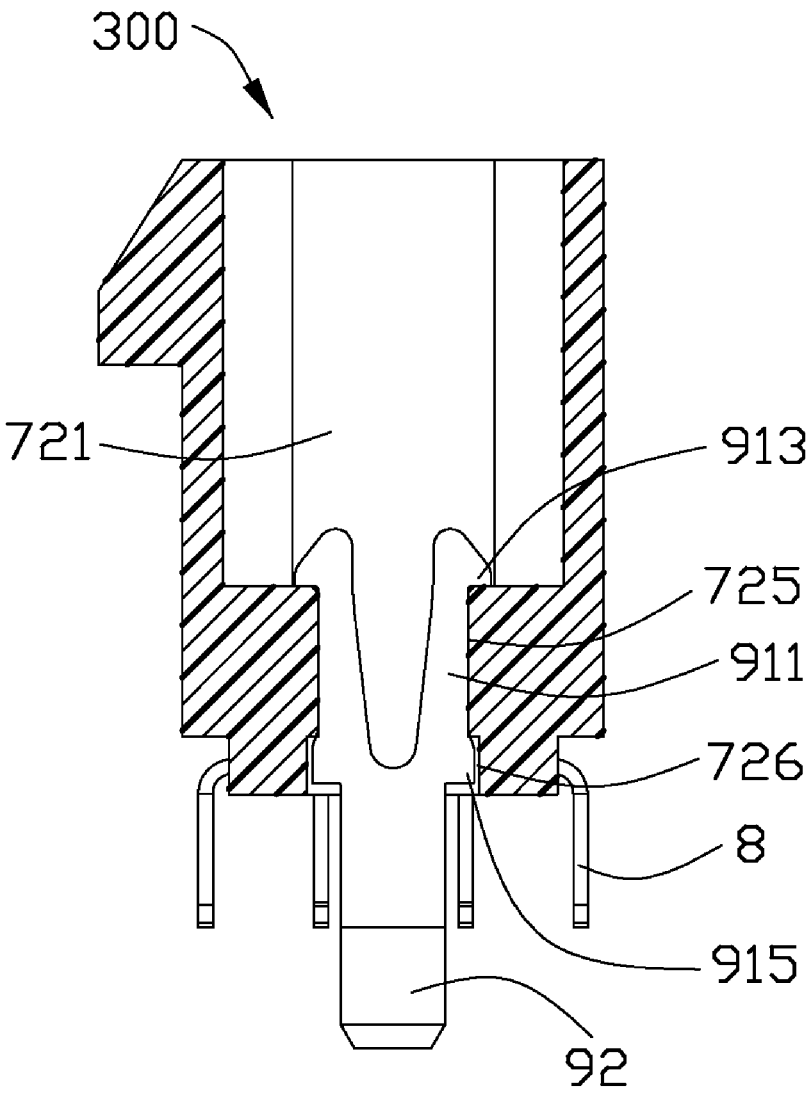
FIG. 10 is a cross-sectional view of the card edge connector taken along line 10-10 of FIG. 7.

Referring to FIGS. 4-6, a card edge connector 200 according to a second embodiment of the present invention is disclosed. The card edge connector 200 also comprises an insulative housing 4, a plurality of terminals 5 received in the housing 4, and a metal hook 6 retained at one side of the housing 4. The hook 6 is similar to a metal screw and includes a fitting portion 61 and a soldering tail 62 for being soldered onto a hole of the mother board for the card edge connector 200 mounted on the mother board reliably. The fitting portion 61 includes an upper column fitting portion 611 and a lower column fitting portion 612 extending downwardly from the upper fitting portion 611. The lower fitting portion 612 is retained in a through hole 462 of a reinforcement wall 46 of the housing 4. The upper fitting portion 611 defines a shoulder 613 protruding laterally beyond the lower fitting portion 612. The shoulder 613 presents as a semi-cylinder shape and presses downwardly against an upper level supporting portion 464 of the reinforcement wall 46 of the housing 4 for preventing the hook 6 from moving downwardly. The shoulder 613 defines an inner vertical surface 614 pressing against a first end wall 42 of the housing 4 to prevent the hook 6 from rotating relative to the housing 4.

Referring to FIGS. 7-10, a card edge connector 300 according to a third embodiment of the present invention is disclosed. The card edge connector 300 also comprises an insulative housing 7, a plurality of terminals 8 retained in the housing 7, and a metal hook 9 retained on an end wall 72 of the housing 7. The hook 9 is formed from a metal plate, and includes an U sharp fitting portion 91, and a soldering tail 92 for being mounted on a mother board for the card edge connector 300 being mounted on the mother board reliably. The fitting portion 91 includes a pair of flexible arms 911 extending upwardly and a gap 912 formed therebetween. The flexible arms 911 can be deflected toward each other. The end wall 72 defines a through hole 721. The flexible arms 911 are retained in the through hole 721 and pressing outwardly against inner walls of the through hole 721 respectively. A lower portion of each of the flexible arms 911 defines a projection 915 locking with a block 725 on the inner wall of the through hole 721 for preventing the hook 9 from moving upwardly. The inner walls of the through hole 721 each defines a recess 726 for receiving the projection 915 and passing downwardly through the housing 7. The block 725 is adjacent to the recess 726. The block 725 is disposed above the recess 726. The projections 915 are close to the soldering tail 92. The flexible arms 911 each defines a distal attachment portion 913 protruding laterally and pressing downwardly against the block 725 for preventing the hook 9 from moving downwardly. Certainly, the through hole 721 can also be formed on a reinforcement wall 76 which protrudes outwardly from the end wall 72 in a lengthwise direction of the housing 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector adapted for mounting on a mother board and receiving a daughter card, comprising:

an insulative housing having a pair of opposed side walls, an end wall connected to the side walls, a retainer and a reinforcement wall both of which protruding outwardly from the end wall in a lengthwise direction of the housing, a central slot formed among the side walls and the end wall for receiving the daughter board;

a plurality of terminals received in the housing and extending into the central slot for mating with the daughter board; and a metal hook retained on the reinforcement wall along an upper-to-lower direction of the housing, and having a soldering tail extending beyond the housing for being soldered on the mother board;

wherein the retainer is connected to the reinforcement wall and defines a flexible retention arm, the retention arm defines a latch projection extending from an inner surface for latching the daughter board; wherein the reinforcement wall extends form a bottom portion of the end wall, and defines a through hole to retain the hook, a receiving space is formed between the end wall, the retainer and the reinforcement wall, the through hole is in communication with the receiving space, the end wall surrounds an inner side of the through hole; wherein the hook includes an upper fitting portion disposed in the receiving space, and a lower fitting portion extending downwardly from the upper fitting portion and retained in the through hole, the upper fitting portion defines a pair of shoulders protruding laterally beyond the lower fitting portion and supported by an upper level surface of the reinforcement wall preventing the hook from moving downwardly; wherein the hook has a pair of flexible arms extending upwardly from the soldering tail retained in the receiving space and the through hole and a gap formed therebetween for the flexible arm being deflected toward each other, the pair of flexible arms each defines a distal attachment portion protruding laterally and pressing downwardly against the reinforcement wall for preventing the hook from moving downwardly.

2. The card edge connector as claimed in claim 1, wherein the flexible arm defines a projection at laterally side of a lower portion thereof locking with a block on an inner wall of the through hole for preventing the hook from moving upwardly, the inner wall of the through hole defines a recess for receiving the projection and passing downwardly through the housing.

3. The card edge connector as claimed in claim 1, wherein the hook includes an upper fitting portion disposed in the receiving space, and a lower fitting portion extending downwardly from the upper fitting portion and retained in the through hole, the upper fitting portion presents as a semi-cylinder shape and defines an inner vertical surface pressing against the end wall of the housing to prevent the hook from rotating.

4. The card edge connector as claimed in claim 1, wherein the hook defines an upper fitting portion disposed in the receiving space, the fitting portion presses against the end wall in the lengthwise direction of the housing and an inner wall of the retainer in a lateral direction of the housing.

5. The card edge connector as claimed in claim 1, wherein the retainer includes a lower base connected to the reinforcement wall, and an upper base protruding upwardly beyond the end wall from the lower base, the upper base defines an upright beam, the retention arm extends from the beam in a lengthwise direction of the housing, and has a release button located at a free end thereof.

6. The card edge connector as claimed in claim 5, wherein the upper base defines a stop arm offsetting outwardly from the retention arm to define a slit formed between the stop arm and the retention arm, the stop arm is adapted for protecting the retention arm from over-deflecting outwardly.

7. A card edge connector for being mounted to a mother board and receiving a daughter board, comprising:

an insulative housing having a pair of opposed side walls, an end wall connected to the side walls, a retainer protruding outwardly from the end wall in a lengthwise direction of the housing, a central slot formed between the side walls and the end wall for receiving the daughter board;

a plurality of terminals received in the housing and extending into the central slot for mating with the daughter board; and a metal hook retained on the end wall along an upper-to-lower direction of the housing, and having a soldering tail extending beyond the housing for being soldered onto a hole of the mother board, the hook including a fitting portion, and a attachment portion and a projection both of which disposed at a lateral side of the fitting portion and offsetting from each other along an upper-to-lower direction of the housing;

wherein the retainer defines a latch projection extending from an inner surface for latching the daughter board;

wherein the end wall defines a through hole for receiving the fitting portion of the hook, and a block located on an inner wall of the through hole;

wherein the block of the end wall is locked with and located between the attachment portion and the projection for preventing the hook from moving along the upper-to-lower direction; wherein the hook includes a pair of flexible arms extending upwardly from the soldering tail, the attachment portion is located at an upper end of the flexible arm, the projection is located at an lower end of the of the flexible arm, the pair of flexible arms press outwardly against inner walls of the through hole respectively.

8. The card edge connector as claimed in claim 7, wherein the block of the end wall defines a level surface, the attachment portion of the flexible arm defines another level surface mating with the level surface of the block.

9. The card edge connector as claimed in claim 7, wherein the housing includes a reinforcement wall extending outwardly from a bottom portion of the end wall in a lengthwise direction of the housing, the reinforcement wall is connected to the retainer.

10. The card edge connector as claimed in claim 7, wherein the retainer includes a lower base connected to the reinforcement wall, and an upper base protruding upwardly beyond the end wall from the lower base, the upper base defines an upright beam, a retention arm, a stop arm both of which extending from the beam in a lengthwise direction of the housing, and a release button located at a free end of the retention arm, the latch projection is disposed on an inner surface of the retention arm, the stop arm offset outwardly from the retention arm to define a slit formed between the stop arm and the retention arm for protecting the retention arm from outward over-deflection.

* * * * *